United States Patent [19]

Reiss et al.

[11] Patent Number: 4,655,136

[45] Date of Patent: Apr. 7, 1987

[54] SHEET MATERIAL OF MECHANICALLY AND ELECTROCHEMICALLY ROUGHENED ALUMINUM, AS A SUPPORT FOR OFFSET-PRINTING PLATES

[75] Inventors: Kurt Reiss, Wiesbaden; Walter Niederstätter, Eltville; Joachim Stroszynski, Wiesbaden; Dieter Bohm, Eltville; Gerhard Sprintschnik, Taunusstein, all of Fed. Rep. of Germany

[73] Assignee: Hoechst Aktiengesellschaft, Frankfurt am Main, Fed. Rep. of Germany

[21] Appl. No.: 577,381

[22] Filed: Feb. 6, 1984

[30] Foreign Application Priority Data

Feb. 14, 1983 [DE] Fed. Rep. of Germany ..... 3305067

[51] Int. Cl.[4] ..... B41N 3/02; C25D 4/44

[52] U.S. Cl. ..... 101/459; 204/129.75; 428/687

[58] Field of Search ..... 428/687; 101/459; 204/129.75, 129.43

[56] References Cited

U.S. PATENT DOCUMENTS

| | | | |
|---|---|---|---|
| 993,938 | 5/1911 | Achert | 101/401.1 |
| 2,344,510 | 3/1944 | Hagelin | 101/459 |
| 3,330,743 | 7/1967 | Jestl | 101/459 |
| 3,834,998 | 9/1974 | Watanabe | 101/459 |
| 3,887,447 | 6/1975 | Sheasby | 101/459 |
| 3,929,591 | 12/1975 | Chu | 101/459 |
| 3,935,080 | 1/1976 | Gumbinner | 101/459 |
| 3,980,539 | 9/1976 | Lloyd | 101/459 |
| 4,072,589 | 2/1978 | Golda | 101/459 |
| 4,087,341 | 5/1978 | Takahashi | 204/129.43 |
| 4,242,417 | 12/1980 | Huang | 101/459 |
| 4,301,229 | 11/1981 | Sakaki | 204/129.43 |
| 4,360,401 | 11/1982 | Gray | 101/459 |
| 4,427,500 | 1/1984 | Platzer | 101/459 |
| 4,477,317 | 10/1984 | Chu | 101/459 |

FOREIGN PATENT DOCUMENTS

| | | | |
|---|---|---|---|
| 36672 | 9/1981 | European Pat. Off. | 101/459 |
| 96347 | 12/1983 | European Pat. Off. | 101/459 |
| 53907 | 5/1976 | Japan | 101/459 |
| 69832 | 6/1977 | Japan | 101/459 |
| 121801 | 9/1979 | Japan | 101/459 |
| 132294 | 10/1980 | Japan | 101/459 |
| 140592 | 11/1980 | Japan | 101/459 |
| 135095 | 10/1981 | Japan | 101/459 |
| WO81/02547 | 9/1981 | PCT Int'l Appl. | 101/459 |
| 2047274 | 11/1980 | United Kingdom | 101/459 |
| 2060923 | 5/1981 | United Kingdom | 101/459 |

*Primary Examiner*—Clyde I. Coughenour

*Attorney, Agent, or Firm*—Schwartz, Jeffery, Schwaab, Mack, Blumenthal & Evans

[57] ABSTRACT

Disclosed is a sheet, foil or strip material comprising aluminum or an alloy thereof, which is first mechanically and then electrochemically roughened on one or both surfaces to produce the following parameters:

(a) from about 60 to 90% of the surface comprise a basic structure, in which the arithmetic mean of the distribution of diameters $D_{a1}$ of the pits is in the range from about 1 to 5 microns, (b) from about 10 to 40% of the surface comprise a superimposed structure formed of elevations having an average base F from about 100 to 1,500 microns$^2$, in which the arithmetic mean of the distribution of diameters $D_{a2}$ of the pits is in the range from about 0.1 to 1.0 micron, (c) the center line average roughnesses $R_a$ of the entire surface are at least 0.6 micron, and (d) the contact area $t_{pmi}$ of the entire surface is not more than about 20% at a stylus working depth of 0.125 micron and not more than about 70% at a stylus working depth of 0.4 micron.

Also disclosed is a process for the production of this material and offset-printing plates which comprise a layer of this material provided with a radiation-sensitive coating.

8 Claims, 4 Drawing Figures

1
2

I
1
2

I

SHEET MATERIAL OF MECHANICALLY AND ELECTROCHEMICALLY ROUGHENED ALUMINUM, AS A SUPPORT FOR OFFSET-PRINTING PLATES

BACKGROUND OF THE INVENTION

The present invention relates to a material in the form of a sheet, a foil or a strip of aluminum or an alloy thereof, which has first been mechanically and then electrochemically roughened on one or both surfaces. The invention also pertains to a process for the production of this material and to its use as a support material in the manufacture of offset-printing plates.

Support materials for offset-printing plates are coated, on one or both sides, with a radiation-sensitive layer (reproduction coating). The coating is applied either directly by the user or by the manufacturer of precoated printing plates. This coating permits the production of a printing image of an original by a photomechanical route. Following the production of this printing form from the printing plate, the coating support comprises image areas which are ink-receptive in the subsequent printing process. Also, simultaneously with the image-production, a hydrophilic image-background for the lithographic printing operation is formed in the areas which are free from an image (non-image areas).

Thus, a coating support for reproduction coatings used in the manufacture of offset-printing plates must meet the following requirements:

Those portions of the photosensitive coating which have become comparatively more soluble following exposure must be capable of being easily removed from the support by a developing operation, in order to produce the hydrophilic non-image areas without leaving a residue and without any stronger attack on the support material by the developer.

The support, which has been laid bare in the non-image areas, must possess a high affinity for water, i.e., it must be strongly hydrophilic, in order to accept water, rapidly and permanently, during the lithographic printing operation, and to exert an adequate repelling effect with respect to the greasy printing ink.

The photosensitive coating must exhibit an adequate degree of adhesion prior to exposure, and those portions of the coating which print must exhibit adequate adhesion following exposure.

Suitable base materials for coating supports of this kind fundamentally include aluminum, steel, copper, brass or zinc foils, and also plastic sheets or paper. By appropriate modifications, such as, for example, graining, matte chromium-plating, surface oxidation and/or application of an intermediate layer, these base materials are converted into coating supports for offset-printing plates. The surface of aluminum, which is presently the most frequently used base material for offset-printing plates, is roughened according to known methods, e.g., dry-brushing, slurry-brushing, sandblasting, or chemical and/or electrochemical treatment. In order to increase the resistance to abrasion, the roughened substrate may additionally be treated in an anodizing step to produce a thin oxide layer.

A printing-plate support provided with a radiation-sensitive coating must, moreover, meet additional requirements, some of which are correlated to the requirements demanded of the support material itself. These requirements include, for example, high radiation-sensitivity (photosensitivity), good developability, clear contrasts after exposure and/or developing, long print runs and a reproduction which is as far as possible true to the original. Particularly in printing plates carrying positive-working radiation-sensitive coatings, a substantially halation-free behavior of the radiation-sensitive coating during irradiation (exposure) of the printing plate and a good water/ink balance of the printing forms (i.e., smallest possible amount of water used and highest possible variation tolerance in water requirement during printing) also play an increasingly important role. From the state of the art, the following publications, for example, are known which provide solutions of a few of the problems, such solutions including, on the one hand, production of elevations in or on the radiation-sensitive coating and, on the other hand, a combination of several roughening steps for the support material:

German Offenlegungsschrift No. 2,512,043 (equivalent to U.S. Pat. No. 4,168,979) discloses a radiation-sensitive printing plate, in which the surface of the radiation-sensitive coating is provided with a matte layer, which is removed upon developing. This matte layer is, generally, a binder layer (e.g., composed of a cellulose ether) which has matting particles dispersed therein, comprising, for example, $SiO_2$, ZnO, $TiO_2$, $ZrO_2$, glass, $Al_2O_3$, starch or polymers. A printing plate constructed in this way is supposed to reduce the time which is required for obtaining a substantially complete and uniform contact between the film original and the radiation-sensitive coating, in the exposure step of the process for manufacturing printing forms.

German Offenlegungsschrift No. 2,926,236 (equivalent to South African Pat. No. 80/3523) discloses a radiation-sensitive copying material comprising, in its positive-working radiation-sensitive coating, particles the smallest dimension of which is at least equal to the thickness of the layer itself and which correspond in quality to the particles described in the above-mentioned German Offenlegungsschrift No. 2,512,043. Such a material should be suitable for any application in which positive contact copies must be produced in a vacuum frame in and which high image resolution and true reproduction of the original are important. In particular, it is stated that the material shows a reduced tendency to halations in the copying process, i.e., halations (lateral and oblique incidence of radiation) may occur during irradiation, as a result of a locally increased distance between the original and the radiation-sensitive coating, and will lead to an imprecise reproduction of small image elements, for example, halftone dots.

However, the process step of applying particles together with a binder to the radiation-sensitive coating or of incorporating particles into the coating without any special binder is expensive and requires a great deal of accuracy, in particular in modern continuously working coating devices. During developing of the coating, the particles which have been applied or admixed to the coating, moreover, present a sort of "foreign matter" to the developing liquid and particularly also to the automatically operating processors and may interfere with the operational flow. The additives, furthermore, do not have any particular effect on the water/ink balance of the printing form.

In the process for the continuous production of a lithographic surface on a metal strip by wet grinding and electrochemical treatment in an electrolyte, according to German Pat. No. 1,962,728 (equivalent to U.S. Pat. No. 3,691,030), the electrolyte is used for wetting during grinding and electrochemical treatment is carried out after grinding. In the process, both grinding and electrochemical treatment can, in each case, produce a roughening effect, for example, on aluminum.

The process for the manufacture of a support for lithographic printing plates, according to German Offenlegungsschrift No. 3,012,135 (equivalent to UK Patent Application No. 2,047,274) is carried out in at least three steps, comprising (a) mechanically roughening the aluminum sheet, (b) removing from 5 to 20 g/m$^2$ of aluminum from the roughened surface and (c) performing an electrochemical roughening treatment, in which electric current of an alternating wave-form is applied in an acidic aqueous solution and in which this current must have specific parameters. Electrochemical roughening may be followed by another abrasive treatment and also by an anodic oxidation of the roughened surface. The surface topography of the support must be such that the primary structure of the surface shows uniform mounds, onto which a secondary structure of pinholes is superimposed. The bisecting axis of each pinhole is approximately perpendicular to the tangent line at the outer face of the corresponding mound. The approximate statistical distribution of pinhole diameters is such that 5% of the holes have a diameter $D_5$ of not more than 3 microns and 95% of the holes have a diameter $D_{95}$ of not more than 7 microns, i.e., the bulk of the holes have diameters in the range between 3 and 7 microns, particularly between 5 and 7 microns. The density of pinholes is approximately $10^6$ to $10^8$ holes per square centimeter. In addition to roughening with a rotating nylon brush with the application of an aqueous pumice slurry, which is the preferred method of roughening and is employed in the only example, it is stated that wire-brushing or ball-graining of the surface may also be used in the mechanical-roughening step; however, this statement is not further specified. Before the abrasive treatment step, the mechanically roughened aluminum has a center line average roughness $R_a$ of 0.4 to 1.0 micron.

Japanese Published Patent Application No. 123 204/78 (Application No. 38238/77, published Oct. 27, 1978) also described a combination of mechanical roughening by nylon brushes with an aqueous pumice slurry and electrochemical roughening, which is used for aluminum support materials for printing plates. An abrasive treatment is carried out after the completion of the two roughening steps, but not between these steps.

British Pat. No. 1,582,620 discloses a combination of (a) mechanically roughening and (b) electrochemically roughening support materials for printing plates by means of an alternating current in an aqueous solution containing HCl and/or $HNO_3$. A detailed specification of the topography of the surface, in respect of quality or quantity, is not given. In the examples, mechanical roughening of aluminum exclusively comprises roughening with oscillating nylon brushes and with the application of an aqueous slurry containing pumice and quartz; the specification also mentions wire-brushing as an alternative method, which is, however, not explained in detail. The aluminum surface is chemically cleaned between the mechanical and electrochemical roughening steps.

The support material for printing plates comprising aluminum, according to U.S. Pat. No. 2,344,510, is initially mechanically roughened, in particular by wire-brushing, and is then chemically or electrochemically roughened. In the procedure, the finer lithographic grain resulting from chemical or electrochemical roughening is to superimpose itself upon the relatively coarse lithographic grain resulting from mechanical roughening. Between the mechanical and the preferred electrochemical roughening treatment, a cleaning step is carried out, which uses a 5% strength aqueous NaOH solution, at 95° C. The roughening electrolyte comprises an aqueous solution containing NaCl and HCl. Roughening may be followed by an anodic oxidation of the material.

U.S. Pat. No. 3,929,591 describes a support material for printing plates which comprises aluminum and is produced in three steps, i.e., (a) a mechanical roughening treatment with the application of a wet mass of abrasive particles based on silicates, oxides or sulfaces, (b) an electrochemical roughening treatment using an alternating current in an aqueous electrolyte containing phosphates or $H_3PO_4$ and (c) an anodic oxidation treatment using direct current in an aqueous electrolyte containing $H_2SO_4$. Step (b) is intended to produce an increase in reflectance of the surface by at least 5%. A detailed qualitative and quantitative specification of the surface topography is not given.

A combination of mechanical and electrochemical roughening may result in an improvement of the water/ink balance; however, the prior art nowhere mentions or suggests that this combination has any effect on a substantially halation-free behavior of radiation-sensitive printing plates so produced. In addition, the comparative tests described below show that an aluminum support for printing plates, even though it has been mechanically roughened or even wire-brushed and then electrochemically roughened and, optionally, subjected to an anodic oxidation treatment of the surface, will by no means yield, on the one hand, a good water/ink balance during printing with these printing forms and, on the other hand, an at least reduced tendency to halation in the manufacture of the printing forms.

SUMMARY OF THE INVENTION

It is therefore an object of the present invention to provide a material comprising aluminum, which can be used to produce offset-printing plates provided with radiation-sensitive coatings.

It is a further object of the invention to provide such printing plates which have a minimal or even no tendency to halation during irradiation in the printing frame and which can be used for a preparation of printing forms which show a good water/ink balance during printing.

Another object of the invention resides in the provision of a process for the production of the improved aluminum sheet material and the printing plates made therefrom.

In accomplishing the foregoing objects, there has been provided in accordance with the present invention a material in the form of a sheet, a foil or a strip, comprising aluminum or an alloy thereof, which has first been mechanically and then electrochemically roughened on one or both surfaces. In the material of the present invention (a) from about 60 to 90% of the surface comprise a basic structure, in which the arithmetic mean of the distribution of pit diameters $D_{a1}$ is in the range from about 1 to 5 microns, (b) from about 10 to 40% of the surface comprise a superimposed structure formed of elevations having an average base F from about 100 to 1,500 microns$^2$, in which the arithmetic means of the distribution of pit diameters $D_{a2}$ is in the range from about 0.1 to 1.0 micron, (c) the center line average roughnesses $R_a$ of the entire surface are at least about 0.6 micron, and (d) the contact area $t_{pmi}$ of the entire surface is not more than about 20%, at a working depth of stylus of 0.125 micron and not more than about 70%, at a working depth of stylus of 0.4 micron.

In a preferred embodiment, the parameters are as follows: (a) $D_{a1}$ is in the range from about 2 to 4 microns, (b) $D_{a2}$ is in the range from about 0.3 to 0.8 micron, at an average base F from about 200 to 1,200 microns$^2$, (c) $R_a$ is in the range from about 0.8 to 1.2 micron and (d) $t_{pmi}$ (0.125) is not more than about 15% and $t_{pmi}$ (0.4) not more than about 60%.

In accordance with another aspect of the invention there has been provided a process for the production of a material comprising the steps of mechanically roughening one or both sides by wire-brushing an aluminum material in the form of a sheet, a foil or a strip, thereafter electrochemically roughening the aluminum material in an electrolyte containing hydrochloric acid and/or nitric acid, with the application of an alternating current. Preferably, the process further comprises the step of subjecting the mechanically roughened material to an intermediate abrasive treatment in an alkaline or acidic aqueous solution, as well as the step of subjecting the material to an abrasive post-treatment in an alkaline or acidic aqueous solution.

In accordance with still another aspect of the invention there has been provided an offset printing plate comprising a support member of the material described above having a radiation-sensitive coating on at least one side thereof.

Further objects, features and advantages of the present invention will become apparent from the detailed description of preferred embodiments which follows when considered with the attached figures of drawings.

DETAILED DESCRIPTION OF PREFERRED EMBODIMENTS

Figures 1, 1A, 1B:
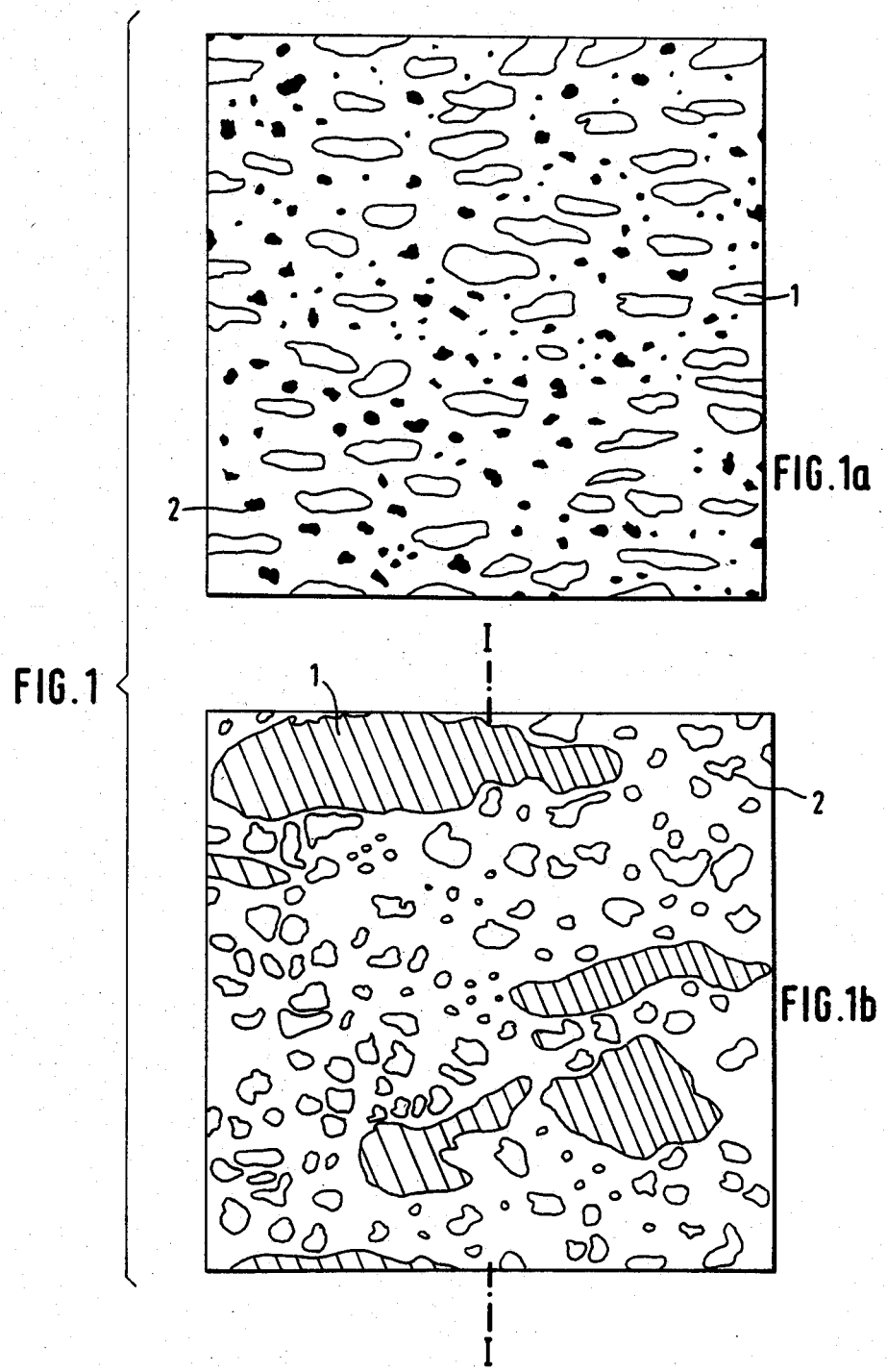
FIG. 1 shows a detail of the surface of a material according to the invention, represented in plan view on two different scales (1 and 1*b*)

Even in commercially available support materials for offset-printing plates, some of these parameters can be within the specified range, however, up to the present, a support material corresponding in all of these parameters to the material of the present invention has not been found. This applies, in particular, to the "double structure" claimed according to the present invention and its effects on the behavior of the printing plate or printing form, respectively. The parameters characterizing the material of the invention are defined as follows:

The roughness of the surface can be measured and analyzed according to different methods. Standard methods include an examination of the surface with a scanning electron microscope and instrument measurements, e.g., by means of a roughness gauge (profilometer) which scans a linear distance on the sheet with a highly sensitive needle.

The diameters of the pits resulting from the roughening process or the bases of the elevation, respectively, are determined with the aid of photographs taken through a scanning electron microscope, for example, at 240, 1,200 or 6,000 times magnification and with oblique incidence of the electron beam, relative to the aluminum surface. Each sample comprises a representative surface section including at least 1,000 pits, which is chosen for measurement. The diameter of each pit is measured in the plane of the surface, in parallel with and also perpendicularly to the axis of rolling or direction of the rolled aluminum strip, respectively. The arithmetic means of the diameters in the parallel and perpendicular directions are separately calculated. The arithmetic mean $D_a$ of the distribution of pit diameters is calculated from the arithmetic means of the pit diameters in the parallel and perpendicular directions. $D_{a1}$ is the arithmetic mean of the distribution of pit diameters in the basic structure and $D_{a2}$ gives the corresponding arithmetic mean for the superimposed structure. These representative surface sections are also used to determine the percentage of basic structure and superimposed structure, from the elevations of the entire surface.

The surface roughness (see, e.g., DIN 4768, October 1970 edition and DIN 4762, May 1978 edition) is measured in parallel with and also perpendicularly to the axis of rolling, by means of a roughness gauge (profilometer, electrical stylus instrument), over a representative measuring length of at least 2 mm. From the two measurements, the center line average roughnesses are separately determined and calculated as the arithmetic means of the absolute distances of all points on the surface of the roughness profile from the center line of profile. The center line average roughness $R_a$ is then the mean value of the center line average roughnesses in the parallel and perpendicular directions. The contact area $t_{pmi}$ corresponds to the ratio in % between the contact length of the roughness profile and the measuring length of the roughness profile, at the working depth of stylus of 0.125 micron or 0.4 micron, which is chosen in each case, i.e., in the present case, $t_{pmi}$ (0.125) is smaller than $t_{pmi}$ (0.4). The contact area $t_{pmi}$ is again the average value of the contact areas in the parallel and perpendicular directions. The roughness profile is regarded as representing the difference between the profile determined by scanning and the enveloping line (path extending over the profile peaks, which is traversed by the center of a ball rolling over the profile and which is generally electronically generated in an electrical stylus instrument). The working depth of stylus refers to the distance from the enveloping line, at which the contact area is determined. A curve drawn from the contact areas (curve of contact areas, Abbott curve) can, for example, provide information about the behavior in use; contact areas which are too great, i.e., which are above the claimed values, lead to less suitable materials in the present field of application. The curve of contact areas takes into account not only the depths, but also the shapes of profile.

The parameters characterizing the present invention thus include the pit diameters and the size distribution thereof in the basic structure and in the superimposed structure formed of elevations, the average base of the elevations, the percentages of basic structure and superimposed structure in the entire roughened surface and the surface roughness distinguished by the center line average roughnesses and the contact area.

Suitable base materials for use in the material of the invention include aluminum or an alloy thereof, for example, containing more than 98.5% by weight of aluminum and Si, Fe, Ti, Cu and Zn constituents. After an optional pre-cleaning treatment, the base material is first mechanically and then electrochemically roughened on one or both sides; in principle, any mechanical and electrochemical roughening processes which, in combination, result in the "double structure" according to the present invention, are suitable for this purpose. The mechanical roughening processes include, for example, wire-brushing and also brushing with rotating brushes which have bristles of a synthetic material, with the application of aqueous abrasive slurries. The electrochemical roughening step is generally carried out in aqueous acids serving as electrolytes. It is, however, also possible to use neutral or acidic aqueous salt solutions which, in each case, may contain additives comprising corrosion inhibitors. After the completion of the mechanical roughening step, the center line average roughness $R_a$ should be at least about 0.5 micron and the contact area $t_{pmi}$ (0.125) not more than about 20%.

The materials of the invention are particularly produced by a process in which the base material, optionally after pre-cleaning, is mechanically roughened on one or both sides by wire-brushing and optionally after an intermediate abrasive treatment in an alkaline or acidic aqueous solution, is thereafter electrochemically roughened in an electrolyte containing hydrochloric acid and/or nitric acid, with the application of an alternating current. Pre-cleaning comprises, for example, treatment in an aqueous NaOH solution with or without a degreasing agent and/or complexing agents, trichloroethylene, acetone, methanol or other so-called aluminum pickles which are commercially available. Wire-brushing has been in use for many years in the art and it is, therefore, not necessary to give a detailed explanation of the process. The abrasive intermediate treatment, which may opitonally also be effected by an electrochemical method, is usually carried out using an aqueous alkali metal hydroxide solution or the aqueous solution of a salt having an alkaline reaction or an aqueous acid solution comprising $HNO_3$, $H_2SO_4$ or $H_3PO_4$ and is preferably continued until 5 g/m$^2$ of material have been removed from the surface.

Similarly, electrochemical roughening—as in independent process—has been used in practice for years. The aqueous electrolyte which is preferably based on aqueous solutions containing HC1 and/or $HNO_3$ may be admixed with corrosion inhibitors or other additives, for example, $H_2SO_4$, $H_2O_2$, $H_3PO_4$, $H_2CrO_4$, $H_3BO_3$, gluconic acid, amines, diamines, surfactants or aromatic aldehydes.

The process parameters in the roughening step, particularly in a continuous procedure, are generally within the following ranges: temperature of the electrolyte between about 20° and 60° C., concentration of active substance (acid, salt) between about 2 and 100 g/l (or even higher in the case of salts), current density between about 25 and 250 A/dm$^2$, dwell time between about 3 and 100 seconds, and flow rate of the electrolyte in continuous processes measured on the surface of the workpiece to be treated between about 5 and 100 cm/second. The type of current used is in most cases alternating current. However, it is also possible to use modified current types, e.g., an alternating current with different amplitudes of current strength for the anode and cathode current. In this procedure, which includes a wire-brushing pre-treatment, the distribution of pit sizes is, in general, more uniform than in processes without previous mechanical roughening. This step is carried out in such a way that the fundamental topography of the mechanically roughened surface, distinguished by the center line average roughness and the contact area, is only relatively slightly changed, while an as far as possible compact pit structure is additionally formed as a result of electrochemical roughening. This is so that the outward appearance shows a basic structure which covers from about 60 to 90% of the surface and has the above-indicated distribution of pit diameters, and a structure appearing as a superimposed structure formed of elevations, which covers from about 10 to 40% of the surface. The frequency of elevations ranges, on an average, from about 200 to 500, particularly from about 250 to 450 per mm$^2$, but it may also vary to be either higher or lower. Electrochemical roughening may additionally be followed by an abrasive treatment using one of the solutions specified for the intermediate treatment. In the process, preferably not more than 2 g/m$^2$ of material are removed.

The roughening process is, as a rule, followed by an anodic oxidation of the aluminum in a further process step, in order to improve, for example, the abrasion and adhesion properties of the surface of the support material. Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. By way of example, the following standard methods are representative of the use of aqueous electrolytes, containing $H_2SO_4$, for the anodic oxidation of aluminum (see, in this regard, e.g., M. Schenk, Werkstoff Aluminium und seine anodische Oxydation (The Material Aluminum and its Anodic Oxidation), Francke Verlag, Bern, 1948, page 760; Praktische Galvanotechnik (Practical Electroplating), Eugen G. Leuze Verlag, Saulgau, 1970, pages 395 et seq., and pages 518/519; W. Huebner and C. T. Speiser, Die Praxis der anodischen Oxidation des Aluminiums (practical Technology of the Anodic Oxidation of Aluminum), Aluminium Verlag, Duesseldorf, 1977, 3rd edition, pages 137 et seq.):

The direct current sulfuric acid process, in which anodic oxidation is carried out in an aqueous electrolyte which conventionally contains approximately 230 g of $H_2SO_4$ per 1 liter of solution, for 10 to 60 minutes at 10° to 22° C., and at a current density of 0.5 to 2.5 A/dm$^2$. In this process, the sulfuric acid concentration in the aqueous electrolyte solution can also be reduced to 8 to 10% by weight of $H_2SO_4$ (about 100 g of $H_2SO_4$ per liter), or it can also be increased to 30% by weight (365 g of $H_2SO_4$ per liter), or more.

The "hard-anodizing process" is carried out using an aqueous electrolyte, containing $H_2SO_4$ in a concentration of 166 g of $H_2SO_4$ per liter (or about 230 g of $H_2SO_4$ per liter), at an operating temperature of 0° to 5° C., and at a current density of 2 to 3 A/dm$^2$, for 30 to 200 minutes, at a voltage which rises from approximately 25 to 30 V at the beginning of the treatment, to approximately 40 to 100 V toward the end of the treatment.

In addition to the processes for the anodic oxidation of aluminum mentioned in the preceding paragraph, the following processes can, for example, also be used: the anodic oxidation of aluminum in an aqueous, $H_2SO_4$ containing electrolyte, in which the content of $Al^3$ ions is adjusted to values exceeding 12 g/l (according to German Offenlegungsschrift No. 2,811,396 equivalent to U.S. Pat. No. 4,211,619) in an aqueous electrolyte containing $H_2SO_4$ and $H_3PO_4$ (according to German Offenlegungsschrift No. 2,707,810 equivalent to U.S. Pat. No. 4,049,504), or in an aqueous electrolyte containing $H_2SO_4$, $H_3PO_4$ and $Al^3$ ions (according to German Offenlegungsschrift No. 2,836,803 equivalent to U.S. Pat. No. 4,229,266). Direct current is preferably used for the anodic oxidation, but it is also possible to use alternating current or a combination of these types of current (for example, direct current with superimposed alternating current). The electrolyte is, particularly, a $H_2SO_4$ and/or $H_3PO_4$ containing aqueous solution. The layer weights of aluminum oxide range from 0.5 to 10 g/m$^2$, which corresponds to a layer thickness of from about 0.15 to 3.0 microns.

Anodic oxidation of the aluminum support material for printing plates is optionally followed by one or more post-treating steps. Post-treating is particularly understood as a hydrophilizing chemical or electrochemical treatment of the aluminum oxide layer, for example, an immersion treatment of the material in an aqueous solution of polyvinyl phosphonic acid according to German Pat. No. 1,621,478 (equivalent to British Pat. No. 1,230,447), an immersion treatment in an aqueous solution of an alkali metal silicate according to German Auslegeschrift No. 1,471,707 (equivalent to U.S. Pat. No. 3,181,461), or an electrochemical treatment (anodization) in an aqueous solution of an alkali metal silicate according to German Offenlegungsschrift No. 2,532,769 (equivalent to U.S. Pat. No. 3,902,976). These post-treatment steps serve, in particular, to improve even further the hydrophilic character of the aluminum oxide layer, which is already sufficient for many fields of application, with the other well-known properties of the layer being at least maintained.

The materials according to the present invention are particularly used as supports for offset-printing plates, i.e., a radiation-sensitive coating is applied to one or both sides of the support material, either by the manufacturer of presensitized printing plates or directly by the user. Suitable radiation-sensitive (photosensitive) coatings basically comprise any coatings which, after irradiation (exposure), optionally followed by developing and/or fixing, yeild a surface in image configuration which can be used for printing.

In addition to the coatings containing silver halides, which are used in many fields, various other coatings are also known, such as those described, for example, in "Light-Sensitive Systems", by Jaromir Kosar, published by John Wiley and Sons, New York, 1965: Colloid coatings containing chromates and dichromates (Kosar, Chapter 2); coatings containing unsaturated compounds, in which, upon exposure, these compounds are isomerized, rearranged, cyclized, or cross-linked (Kosar, Chapter 4); coatings containing compounds which can be photopolymerized, which, upon exposure, undergo polymerization of the monomers or prepolymers, optionally with the aid of an initiator (Kosar, Chapter 5); and coatings containing o-diazoquinones, such as naphthoquinonediazides, p-diazoquinones, or condensation products of diazonium salts (Kosar, Chapter 7). Other suitable coatings include the electrophotographic coatings, i.e., coatings which contain an inorganic or organic photoconductor. In addition to the photosensitive substances, these coatings can, of course, also contain other constituents, such as, for example, resins, dyes or plasticizers. In particular, the following photosensitive compositions or compounds can be employed in the coating of support materials prepared according to the process of the present invention: positive-working reproduction coatings which contain, as the photosensitive compound, o-quinone diazides, particularly o-naphthoquinone diazides, for example, 1,2-naphthoquinone-2-diazide-sulfonic acid esters or amides, which may have low or higher molecular weights, as described, for example, in German Pat. Nos. 854,890, 865,109, 879,203, 894,959, 938,233, 1,109,521, 1,144,705, 1,118,606, 1,120,273, 1,124,817 and 2,331,377 and in published European Patent Applications No. 0,021,428 and No. 0,055,814; negative-working reproduction coatings which contain condensation products from aromatic diazonium salts and compounds with active carbonyl groups, preferably condensation products formed from diphenylaminediazonium salts and formaldehyde, which are described, for example, in German Pat. Nos. 596,731, 1,138,399, 1,138,400, 1,138,401, 1,142,871, and 1,154,123, U.S. Pat. Nos. 2,679,498 and 3,050,502 and British Pat. No. 712,606; negative-working reproduction coatings which contain co-condensation products of aromatic diazonium compounds, for example, according to German Offenlegungsschrift No. 2,024,244, comprising products which possess, in each case, at least one unit of (a) an aromatic diazonium salt compound which is capable of condensation and (b) a compound, such as a phenol ether or an aromatic thioether, which is capable of condensation, connected by a bivalent intermediate member derived from a condensable carbonyl compound, for example, a methylene group; positive-working coatings according to German Offenlegungsschrift No. 2,610,842, German Pat. No. 2,718,254 or German Offenlegungsschrift No. 2,928,636, which contain a compound which, on being irradiated, splits off an acid, a monomeric or polymeric compound which possesses at least one C—O—C group which can be split off by acid (e.g., an orthocarboxylic acid ester group, or a carboxamide-acetal group), and, if appropriate, a binder; negative-working coatings, composed of photopolymerizable monomers, photo-initiators, binders and, if appropriate, further additives. In these coatings, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften No. 2,064,079 and No. 2,361,041; negative-working coatings according to German Offenlegungsschrift No. 3,036,077, which contain, as the photosensitive compound, a diazonium salt polycondensation product, or an organic azido compound, and which contain, as the binder, a high-molecular weight polymer with alkenylsulfonylurethane or cycloalkenylsulfonylurethane side groups.

It is also possible to apply photo-semiconducting coatings to the support materials manufactured according to the invention, such as described, for example, in German Pat. Nos. 1,117,391, 1,522,497, 1,572,312, 2,322,046 and 2,322,047 as a result of which highly photosensitive electrophotographically-working printing plates are produced. Of the coatings mentioned above, the positive-working radiation-sensitive coatings are peferably used.

The coated offset-printing plates which are obtained from the support materials according to the invention are converted into the desired printing form, in a known manner, by imagewise exposure or irradiation, and rinsing the non-image areas with a developer, preferably an aqueous developing solution.

The materials according to the present invention have the advantage that, after the application of a radiation-sensitive coating, a reproduction material results, which shows a minimal halation in the irradiation procedure in the printing frame and from which, moreover, printing forms are obtained which exhibit a good water-/ink balance in the printing operation (good capacity of accumulating water and low water requirement, quick roll-up during printing). In addition, a great number of the above-defined requirements demanded of a reproduction material which is useful in practice can be fulfilled, and this applies, in particular, to the requirements concerning the interaction of the support material/-radiation-sensitive coating, so that it is possible to produce a useful support material which satisfies even utmost requirements and can, moreover, be continuously produced in modern strip processing equipment, if the parameters according to the invention are complied with. It is also a particular advantage of the material that it has an elevated mechanical resistance, as can be demonstrated, for example, by an increase in the length of print runs.

Figure 2:
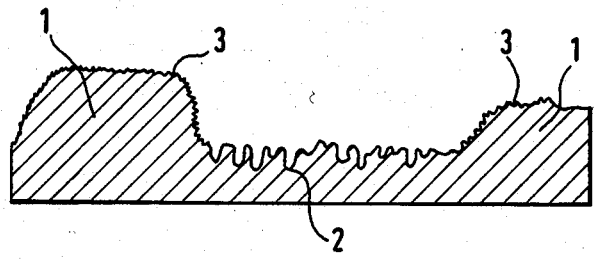
FIG. 2 is a detail of the surface of a material according to the invention, shown in a sectional view along the line I—I in FIG. 1.
Figure 3:
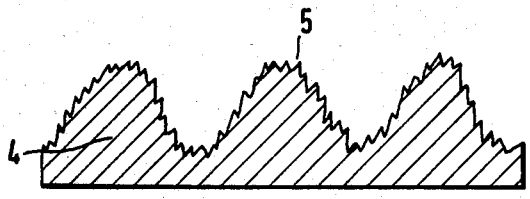
PRIOR ART FIG.3
FIG. 3 is a detail of the surface of a prior art material which has only been mechanically roughened, shown in a sectional view, perpendicularly to the material base.
Figure 4:
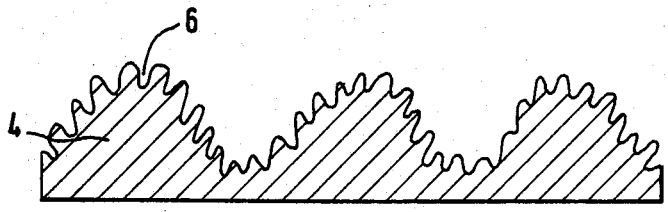
PRIOR ART FIG.4
FIG. 4 is a detail of the surface of a prior art material, which has been mechanically and electrochemically roughened, shown in a cross-sectional view, perpendicularly to the material base.

Turning now to the drawings, FIGS. 1*a* and 1*b* (magnification approximately 240 and 1,200 times, respectively), which have been prepared from microphotographs taken under a scanning electron microscope, depict the different orders of magnitude and the distribution of pits 2 in the basic structure according to characteristic (a) and the distribution of elevations 1 in the superimposed structure according to characteristic (b). FIG. 2 represents a sectional view of the surface, which is not to scale, but which additionally shows the approximate size relation between the pits 3 in the elevations 1 of the superimposed structure and the pits 2 in the basic structure. FIGS. 3 and 4 show aluminum sheets which were prepared according to UK Patent Application No. 2,047,274. FIG. 3 shows the primary structure of a surface comprising uniform mounds 4 and pits 5 which are present in these mounds, in which the respective bisecting axis of a pit is approximately perpendicular to the base of the material. FIG. 4 shows the comparable primary structure of the surface, comprising uniform mounds 4 and the pits 6 which form a secondary structure superimposed upon the primary structure and the respective bisecting axes of which are approximately perpendicular to the tangent lines at the outer faces of the mounds.

In the examples which follow, percentages are related to weight and parts by weight are related to parts by volume as the kg is related to the $dm^3$, unless otherwise indicated.

EXAMPLE 1

An aluminum strip is continuously mechanically roughened on one side by wire-brushing, which results in a surface having a center line average roughness $R_a$=0.90 micron and a contact area $t_{pmi}$ (working depth of stylus 0.125 micron)=13%. The mechanically roughened strip is intermediately treated for 3 seconds in a 4% strength aqueous solution of NaOH at 70° C., such that about 3 $g/m^2$ of material are abraded from the surface. Electrochemical roughening is also continuously conducted in a 0.9% strength aqueous solution of $HNO_3$ containing 4% of Al $(NO_3)_3$, at 40° C., a dwell time of 10 seconds and using an alternating current at a current density of 170 $A/dm^2$. The mechanically and electrochemically roughened support shows the following parameters: $D_{a1}$=2.8 microns, $D_{a2}$=0.8 micron, basic structure=75%, superimposed structure=25%, F=500 $microns^2$, $R_a$=1.0 micron, $t_{pmi}$ (0.125)=18% and $t_{pmi}$ (0.4)=67%. The ensuing anodic oxidation is carried out in a 10% strength aqueous solution of $H_3PO_4$ at 60° C., using a direct current, until the weight of the oxide layer is about 0.6 $g/m^2$. A support material prepared according to this procedure is cut into sheets, and one of these sheets is coated with a negative-working radiation-sensitive coating composed of:

100 parts by volume of ethylene glycol monomethyl ether, 50 parts by volume of tetrahydrofuran, 0.4 part by weight of crystal violet, 0.2 part by weight of an 85% strength $H_3PO_4$, and 2 parts by weight of a polycondensation product, prepared from 1 mole of 3-methoxy-diphenylamine-4-diazonium sulfate and 1 mole of 4,4'-bismethoxymethyl diphenyl ether in an 85% strength $H_3PO_4$ and isolated as the mesitylene sulfonate, to give a layer weight of 0.4 $g/m^2$ after drying of the coating. After image-wise exposure under a complex original, the material is developed with a solution composed of 89 parts by volume of water, 5 parts by weight of sodium undecanoate, 3 parts by weight of a non-ionic surfactant (block polymer of 80% propylene oxide and 20% ethylene oxide) and 3 parts by weight tetrasodium diphosphate. Image reproduction in the printing process is excellent, water/ink balance is good, and it is possible to print about 120,000 good quality copies.

COMPARATIVE EXAMPLE C1

The procedure indicated in Example 1 is followed, except that mechanical roughening and alkaline intermediate treatment are omitted. The topography of the surface ("double structure") which can be produced in Example 1 is not achieved, instead, an irregularly roughened, scarred support is obtained. Image reproduction, water/ink balance and print run are far worse than in Example 1.

COMPARATIVE EXAMPLE C2

The procedure indicated in Example 1 is followed, however, wire-brushing is carried out in such a way that the mechanically roughened surface has an $R_a$ value of about 0.39 micron and a $t_{pmi}$ (0.125) value of about 37%. After electrochemical roughening this support material is more uniformly roughened than the material of Comparative Example C1, but it does not come up to the required ranges of parameters, particularly in the $R_a$ and $t_{pmi}$ values, and it still does not have a "double structure". Although image reproduction, ink/water balance and print run are somewhat better than C1, they are still markedly inferior to Example 1.

EXAMPLE 2

An aluminum strip is continuously mechanically roughened on one side by wire-brushing. The resulting surface has an $R_a$ value of 0.65 micron and a $t_{pmi}$ (0.125) value of 15%. The mechanically roughened strip is intermediately treated as described in Example 1. Electrochemical roughening is carried out in a 1.5% strength aqueous solution of $HNO_3$ containing 5% of $Al(NO_3)_3$, at 30° C., a dwell time of 15 seconds and using an alternating current at a current density of 100 A/dm$^2$. The mechanically and electrochemically roughened support shows the following parameters: $D_{a1}$=3.7 microns, $D_{a2}$=0.6 micron, basic structure=80%, superimposed structure=20%, F=720 microns$^2$, $R_a$=0.95 micron, $T_{pmi}$ (0.125)=17% and $T_{pmi}$ (0.4)=60%. After another abrasive treatment of the surface for 2 seconds in a 2%strength aqueous solution of NaOH at 35° C., by which about 0.6 g/m$^2$ of material are abraded from the surface, the aluminum is anodically oxidized in a 25% strength aqueous $H_2SO_4$ solution at 50° C., using a direct current, until the weight of the oxide layer is about 2 g/m$^2$. The radiation-sensitive coating according to Example 1 which is to be applied, additionally contains 5.5 parts by weight of a reaction product obtained by reaction a polyvinyl butyral (comprising vinyl butyral, vinyl acetate and vinyl alcohol units) with propenyl sulfonyl isocyanate. Developing is carried out in a weakly alkaline aqueous solution, containing 1% of sodium metasilicate, 3% of a nonionic surfactant and 5% of benzyl alcohol. Image reproduction and water/ink balance correspond to Example 1; the print run obtained exceeds that of Example 1 by about 50,000 copies.

EXAMPLE 3

The procedure indicated in Example 2 is followed; however, after the anodic oxidation, the surface of the support material is additionally anodically treated at 36 V in a 17% strength aqueous sodium silicate solution at 70° C. for a period of 15 seconds and is then rinsed with a 1.5% strength aqueous solution of $H_3PO_4$. The radiation-sensitive coating which is applied comprises a positive-working mixture composed of

- 8.5 parts by weight of the esterification product of 1 mole of 2,3,4-trihydroxybenzophenone and 3 miles of 1,2-naphthoquinone-2-diazide-5-sulfonic acid chloride,
- 6.6 parts by weight of the esterification product of 1 mile of 2,2'-dihydroxynaphthyl (1,1')-methane and 2 moles of the above-described acid chloride,
- 2.1 parts by weight of 1,2-naphthoquinone-2-diazide-4-sulfonic acid chloride,
- 35 parts by weight of a cresol-formaldehyde novolak,
- 0.75 part by weight of crystal violet,
- 260 parts by volume of ethylene glycol monomethyl ether,
- 470 parts by volume of tetrahydrofuran, and
- 80 parts by volume of butyl acetate, to give a layer weight of 2.5 g/m$^2$ after drying. After exposure, the material is developed with an aqueous solution containing 5.3% of sodium metasilicate.9 $H_2O$, 3.4% of $Na_3PO_4$.12 $H_2O$ and 0.3% of $NaH_2PO_4$. Image reproduction during printing is excellent, water/ink balance is good and it is possible to print about 400,000 good quality copies (after carrying out a baking operation).

COMPARATIVE EXAMPLE C3

The procedure indicated in Example 3 is followed, except that the mechanical roughening and the alkaline intermediate treatment are omitted. The topography of the surface ("double structure") according to Example 3 is not achieved. Instead, a rather irregularly roughened and lightly scarred support is obtained. Image reproduction, water/ink balance and print run are far worse than in Example 3.

COMPARATIVE EXAMPLE C4

The procedure indicated in Example 3 is followed; however, wire-brushing is carried out such that the $R_a$ value of the mechanically roughened surface is about 0.40 micron and the $t_{pmi}$ (0.125) value is about 35%. Although this support material is more uniformly roughened after electrochemical roughening than the material of Comparative Example C3, it does not reach the ranges of parameters claimed, in particular in its $R_a$ and $t_{pmi}$ values, and it still does not have a "double structure". Image reproduction, water/ink balance and print run are improved over C3, but are still markedly inferior to Example 3.

COMPARATIVE EXAMPLE C5

The procedure of Example 3 (in combination with Example 2) is followed: however, brushing with oscillating nylon brushes with the application of an aqueous abrasive slurry is substituted for wire-brushing. Before carrying out electrochemical roughening, a surface is thus obtained, which has an $R_a$ value of 0.60 micron and a $t_{pmi}$ (0.125) value of 20%. After electrochemical roughening, the support material is relatively uniformly roughened; however, the surface does not show a "double structure", i.e., the parameters resulting from this specific structure are not present or are not within the ranges claimed according to this invention. After the preparation of a printing form, it is found that water/ink balance and print run are better than in C4, but still do not correspond to Example 3. In particular, there is practically no improvement in the tendency toward halation.

EXAMPLES 4 and 5

The procedure used in Example 3 is followed, with the difference that either a matte layer according to U.S. Pat. No. 4,168,979 is applied to the radiation-sensitive coating or particles are admixed to the radiation-sensitive coating, according to South African Pat. No. 80/3523. These modifications of the coating are intended to reduce the tendencey toward halation (cf. introductory part of the specification). Image reproduction obtained with printing forms so prepared is virtually unchanged compared with that of printing forms prepared according to Example 3, without any modification of the coating, i.e., if a material having the "double structure" of the present invention is used as a support for offset printing plates, this kind of special modification of the radiation-sensitive coating can be dispensed with.

EXAMPLE 6

An aluminum strip is continuously mechanically roughened on one side by wire-brushing, which produces a surface having an $R_a$ value of 1.0 micron and $t_{pmi}$ (0.125) value of 10%. The mechanically roughened strip is intermediately treated for 10 seconds in a 3% strength aqueous solution of NaOH at 50° C., so that about 2.5 g/m$^2$ of material are abraded from the surface. Electrochemical roughening is also continuously conducted in a 1% strength aqueous HC1 solution containing 2% of $AlCl_3.6\ H_2O$, at a temperature of 40° C., a dwell time of 20 seconds and using alternating current at a current density of 70 A/dm$^2$. The mechanically and electrochemically roughened support shows the following parameters: $D_{a1}$—3.0 microns, $D_{a2}$=0.8 micron, basic structure 87%, superimposed structure 13%, F=300 microns$^2$, $R_a$=1.7 microns, $t_{pmi}$ (0.125)=8%, and $t_{pmi}$ (0.4)=40%. Anodic oxidation and application of a radiation-sensitive coating are carried out as described in Example 1. Image reproduction and water-/ink balance are rather better than in Example 1, and a print run of about 100,000 copies is obtained.

What is claimed is:

1. A support material in the form of a sheet, a foil or a strip comprising aluminum or an alloy thereof, which has been first mechanically roughened and then electrochemically roughened on one or both surfaces, said aluminum support comprising a first structure comprising about 60–90% of the support surface, which includes a plurality of pits in which the arithmetic means of the distribution of pit diameters $D_{a1}$ is in the range from about 1 to 5 microns, and a second structure, raised in relation to said first structure, having an average base F from about 100 to 1500 microns$^2$ and comprising about 10–40% of the support surface, said second structure including a plurality of pits in which the arithmetic mean of the distribution of pit diameters $D_{a2}$ is in the range from about 0.1 to 1 micron.

2. A support material as claimed in claim 1, wherein parameters are as follows: $D_{a1}$ is in the range from about 2 to 4 microns, and $D_{a2}$ is in the range from about 0.3 to 0.8 micron, at an average base F from about 200 to 1,200 microns$^2$.

3. A material as claimed in claim 1, wherein the surface of the material additionally comprises an aluminum oxide layer which has been generated by anodic oxidation.

4. A material as claimed in claim 2, wherein the surface of the material additionally comprises an aluminum oxide layer which has been generated by anodic oxidation.

5. A material as claimed in claim 3, wherein the aluminum oxide layer has been post-treated to render it hydrophilic.

6. A material as claimed in claim 4, wherein the aluminum oxide layer has been post-treated to render it hydrophilic.

7. An offset printing plate comprising a support member comprised of the material as claimed in claim 1, having a radiation-sensitive coating on at least one side thereof.

8. An offset printing plate as claimed in claim 7, wherein said radiation-sensitive coating comprises a positive-working composition.

* * * * *